US010219614B2

(12) United States Patent
Castaneda Roldan et al.

(10) Patent No.: US 10,219,614 B2
(45) Date of Patent: Mar. 5, 2019

(54) RECONFIGURABLE CONFERENCE TABLE

(71) Applicant: STEELCASE INC., Grand Rapids, MI (US)

(72) Inventors: Felipe Efrain Castaneda Roldan, Grand Rapids, MI (US); Rachel Anne Neiman, Grand Rapids, MI (US); Robert Scheper, Grand Rapids, MI (US); Eric Arenson, Forest Grove, OR (US)

(73) Assignee: STEELCASE INC., Grand Rapids, MI (US)

( * ) Notice: Subject to any disclaimer, the term of this patent is extended or adjusted under 35 U.S.C. 154(b) by 25 days.

(21) Appl. No.: 15/484,711

(22) Filed: Apr. 11, 2017

(65) Prior Publication Data

US 2017/0295918 A1 Oct. 19, 2017

Related U.S. Application Data

(60) Provisional application No. 62/323,029, filed on Apr. 15, 2016.

(51) Int. Cl.
*A47B 13/08* (2006.01)
*A47B 21/03* (2006.01)

(52) U.S. Cl.
CPC ..... *A47B 13/081* (2013.01); *A47B 13/088* (2013.01); *A47B 21/0314* (2013.01); *A47B 2200/0079* (2013.01)

(58) Field of Classification Search
CPC . A47B 13/081; A47B 13/088; A47B 21/0314; A47B 2200/0079
(Continued)

(56) References Cited

U.S. PATENT DOCUMENTS 1,158,125 A * 10/1915 Fink ..... A47B 1/056 108/66
1,384,925 A 7/1921 Seiler
(Continued)

FOREIGN PATENT DOCUMENTS

CN 204635411 U 9/2015
CN 204812639 U 12/2015
(Continued)

OTHER PUBLICATIONS

U.S. Appl. No. 15/170,550, filed Jun. 1, 2016.
(Continued)

*Primary Examiner* — Jose V Chen
(74) *Attorney, Agent, or Firm* — Brinks Gilson & Lione

(57) ABSTRACT

A reconfigurable conference table includes an annulus shaped worksurface having radially spaced inner and outer peripheral edges. The inner peripheral edge defines a center opening having a center axis. The worksurface is moveable between a contracted configuration and an expanded configuration. The worksurface may include at least three sectors supported by and moveable relative to circumferentially spaced support nodes radially spaced from the center axis. At least two of the support nodes are moveable toward and away from the center axis. First and second monitors, facing inwardly toward the center opening, may be positioned above and below the worksurface. Methods of assembling and reconfiguring the conference table are also provided.

19 Claims, 16 Drawing Sheets

(58) Field of Classification Search
USPC ..... 108/50.01, 50.02, 65, 66, 67, 68
See application file for complete search history.

(56) References Cited

U.S. PATENT DOCUMENTS 1,547,685 A * 7/1925 Rhodes ..... A47B 13/088 108/66
2,536,511 A 1/1951 Megies
2,540,291 A 2/1951 Reingold
2,703,740 A 3/1955 Cochard
D194,468 S 1/1963 Goodman
D196,121 S 8/1963 Soszynski
3,120,405 A 2/1964 Soszynski
D206,998 S 2/1967 Benjamin
D209,911 S 1/1968 Cooper
3,477,760 A 11/1969 Bue et al.
3,683,825 A * 8/1972 Sheldon ..... A47B 3/00 108/176
4,069,770 A 1/1978 Bertelsen
4,378,468 A * 3/1983 Braun ..... H04R 27/00 381/93
4,400,724 A 8/1983 Fields
D272,302 S 1/1984 Connelly
D274,581 S 7/1984 Gallock
4,758,887 A 7/1988 Engel et al.
4,836,114 A * 6/1989 Cohen ..... A47B 13/023 108/60
D327,178 S 6/1992 Ryaa
5,156,095 A 10/1992 Hansback et al.
5,159,445 A 10/1992 Gitlin et al.
5,194,955 A 3/1993 Yoneta et al.
D337,000 S 7/1993 Williams
5,237,937 A 8/1993 Peltier et al.
D339,487 S 9/1993 Rizzi
5,243,413 A 9/1993 Gitlin et al.
5,282,027 A 1/1994 Tanigaki et al.
D352,182 S 11/1994 Yoshimura
5,400,069 A 3/1995 Braun et al.
5,406,323 A 4/1995 Tanigaki et al.
5,421,271 A * 6/1995 Sui ..... A47B 11/00 108/20
5,448,287 A 9/1995 Hull
5,470,128 A 11/1995 Kerkham
5,612,733 A 3/1997 Flohr
5,619,254 A 4/1997 McNelley
5,676,068 A 10/1997 Kallander
5,808,663 A 9/1998 Okaya
D409,008 S 5/1999 Lunn
5,953,052 A 9/1999 McNelley et al.
6,009,814 A 1/2000 Rossi
6,012,398 A * 1/2000 Boyce ..... A47B 13/10 108/25
6,037,970 A 3/2000 Kondo
D434,738 S 12/2000 Takemasa
6,160,573 A 12/2000 Allen et al.
6,243,130 B1 6/2001 McNelley et al.
D447,365 S 9/2001 Chi
D456,645 S 5/2002 Iverson
6,550,921 B1 4/2003 Monson
D474,454 S 5/2003 Izu et al.
6,606,111 B1 8/2003 Kondo et al.
D482,536 S 11/2003 Williams
6,798,441 B2 9/2004 Hartman et al.
6,994,032 B2 2/2006 Conley et al.
7,077,464 B2 7/2006 Ford et al.
7,092,002 B2 8/2006 Ferren et al.
7,119,829 B2 10/2006 Leonartd et al.
7,126,627 B1 10/2006 Lewis et al.
D542,243 S 5/2007 Lewis
7,311,047 B2 12/2007 Conley et al.
7,352,809 B2 4/2008 Wenger et al.
7,357,086 B2 * 4/2008 Petrick ..... A47B 21/00 108/50.02
D572,918 S 7/2008 Viets
7,455,018 B2 11/2008 Conley et al.
7,464,653 B2 12/2008 Dodge
D588,560 S 3/2009 Mellingen et al.
D588,825 S 3/2009 van Ierssel
7,515,174 B1 4/2009 Francisco et al.
7,558,823 B2 7/2009 Beers et al.
7,679,639 B2 3/2010 Harrell et al.
7,707,247 B2 4/2010 Dunn et al.
D615,514 S 5/2010 Mellingen et al.
7,710,448 B2 5/2010 De Beer et al.
7,710,450 B2 5/2010 Dhuey et al.
7,746,373 B2 6/2010 Martini
7,801,430 B2 9/2010 Gorzynski et al.
D626,103 S 10/2010 Buzzard et al.
D628,175 S 11/2010 Desai et al.
D628,968 S 12/2010 Desai et al.
7,847,814 B2 12/2010 Ferren et al.
7,855,726 B2 12/2010 Ferren et al.
D632,661 S 2/2011 Micallef
7,884,846 B2 2/2011 Ferren et al.
7,884,855 B2 2/2011 Ortiz
7,916,165 B2 3/2011 Ferren et al.
D637,568 S 5/2011 Desai et al.
8,130,256 B2 3/2012 Trachtenberg et al.
D659,427 S 5/2012 Nicholas
8,259,155 B2 9/2012 Marathe et al.
8,289,363 B2 10/2012 Buckler
8,299,979 B2 10/2012 Rambo et al.
8,319,819 B2 11/2012 MacDonald et al.
8,330,791 B2 12/2012 Gorzynski et al.
8,345,082 B2 1/2013 Tysso
8,355,041 B2 1/2013 Chen et al.
8,358,328 B2 1/2013 Friel et al.
8,384,824 B2 2/2013 Miyagawa et al.
8,405,704 B2 3/2013 Kobayashi et al.
8,407,944 B2 4/2013 Baloga et al.
8,446,455 B2 5/2013 Lian et al.
8,456,506 B2 6/2013 Ferren et al.
8,477,175 B2 7/2013 Shaffer et al.
D688,074 S 8/2013 Lin
8,526,632 B2 9/2013 Cutler
8,659,637 B2 2/2014 De Beer et al.
8,675,038 B2 3/2014 Wessling
8,692,862 B2 4/2014 N'Guessan
8,704,867 B2 4/2014 Hubenthal et al.
8,773,495 B2 7/2014 Saleh et al.
8,797,377 B2 8/2014 Mauchly et al.
8,997,661 B1 4/2015 Kilday
9,058,055 B2 6/2015 Ferren et al.
D808,197 S 1/2018 Castaneda Roldan et al.
2004/0008423 A1 1/2004 Driscoll, Jr. et al.
2004/0207718 A1 10/2004 Boyden et al.
2004/0216647 A1 11/2004 Cvek
2005/0062844 A1 3/2005 Ferren et al.
2005/0263041 A1* 12/2005 Mueller ..... A47B 21/06 108/50.02
2007/0279483 A1 12/2007 Beers et al.
2007/0290531 A1 12/2007 Larsen
2008/0115697 A1* 5/2008 Beam ..... A47B 13/08 108/26
2008/0237412 A1 10/2008 Chinuki et al.
2008/0295743 A1* 12/2008 Beam ..... A47B 21/00 108/50.02
2009/0207233 A1 8/2009 Mauchly et al.
2010/0118112 A1 5/2010 Nimri et al.
2010/0208078 A1 9/2010 Tian et al.
2011/0134204 A1 6/2011 Rodriguez et al.
2011/0309659 A1* 12/2011 Beauchamp ..... A47B 13/081 297/135
2015/0150374 A1 6/2015 Jones
2016/0000218 A1* 1/2016 Hsu ..... A47B 13/081 108/21
2017/0360187 A1* 12/2017 Rossi ..... A47B 1/10

FOREIGN PATENT DOCUMENTS

DE 124355 B 6/1967
DE 3331481 A1 3/1985
DE 8707699 U1 9/1987

(56) References Cited

FOREIGN PATENT DOCUMENTS

| | | | |
|---|---|---|---|
| DE | 4207742 | A1 | 9/1993 |
| DE | 29600611 | U1 | 3/1996 |
| DE | 102008017995 | A1 | 10/2009 |
| EP | 740177 | A2 | 10/1996 |
| EP | 1610555 | A1 | 12/2005 |
| FR | 2758063 | A1 | 7/1998 |
| GB | 206400 | A | 11/1923 |
| GB | 2396552 | A | 3/2004 |
| GB | 2353429 | A | 6/2004 |
| GB | 2484944 | A | 5/2010 |
| JP | 4344789 | A | 12/1992 |
| TW | 340324 | Y | 9/1998 |
| WO | WO1998047291 | A2 | 10/1998 |
| WO | WO200122848 | A2 | 4/2001 |
| WO | WO2008101117 | A1 | 8/2008 |
| WO | WO2009120814 | A2 | 10/2009 |
| WO | WO2010033036 | A1 | 3/2010 |
| WO | WO2010104765 | A1 | 9/2010 |
| WO | WO2012/001017 | | 12/2012 |

OTHER PUBLICATIONS

U.S. Appl. No. 29/561,429, filed Apr. 15, 2016 entitled "Conference Table", 25 pages.
U.S. Appl. No. 29/561,434, filed Apr. 15, 2016 entitled "Worksurface for a Conference Table", 26 pages.

* cited by examiner

FIG. 5
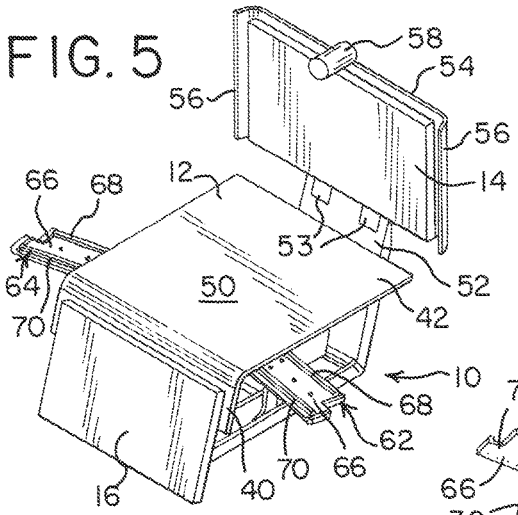
FIG. 6
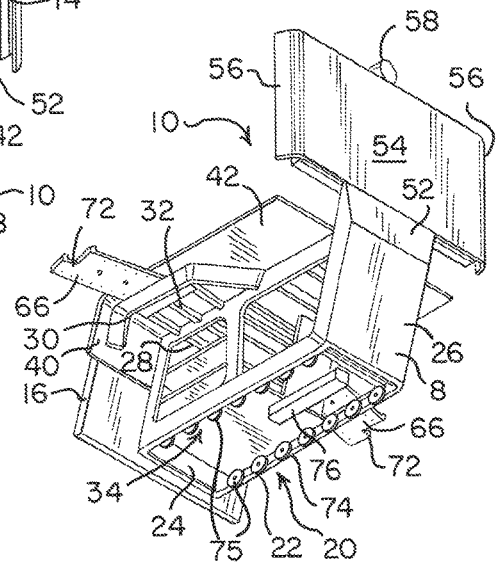
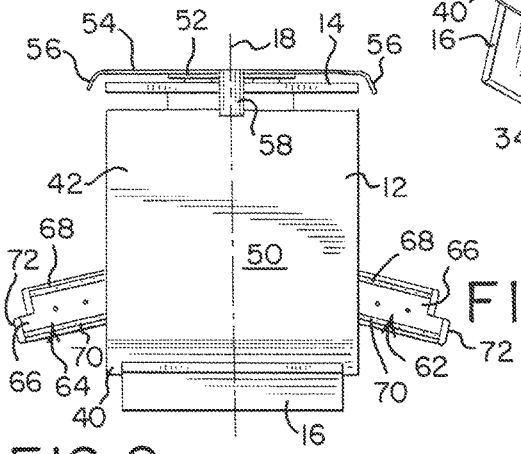
FIG. 7
FIG. 8
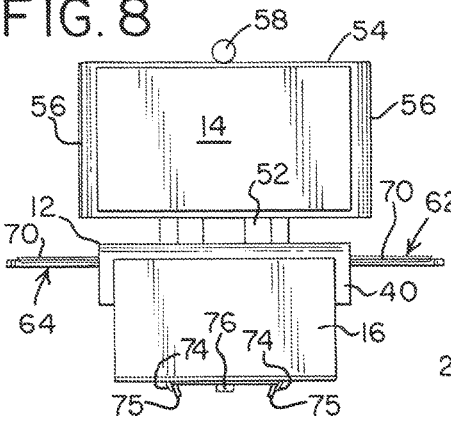
FIG. 9
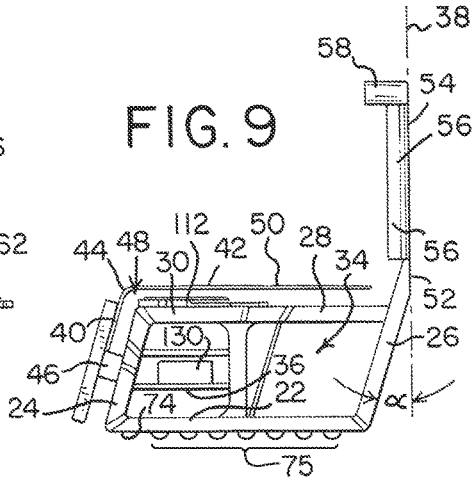

FIG.16
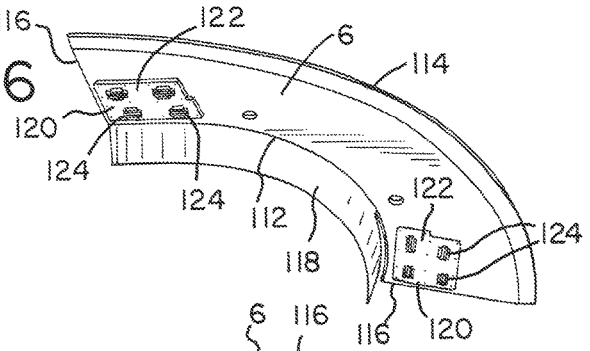
FIG. 17
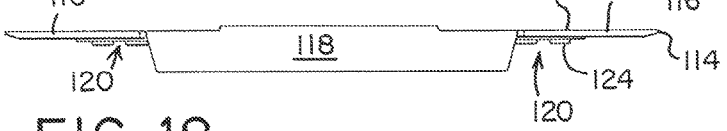
FIG. 18
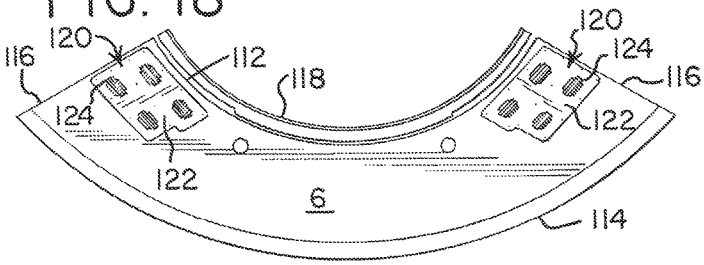
FIG. 19
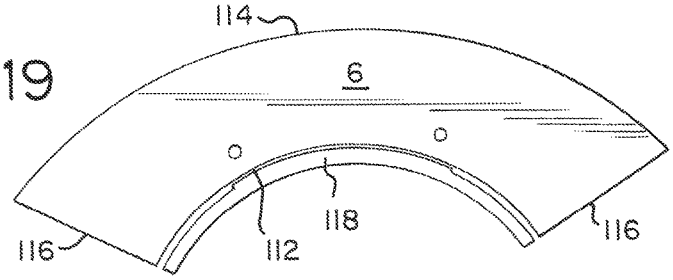
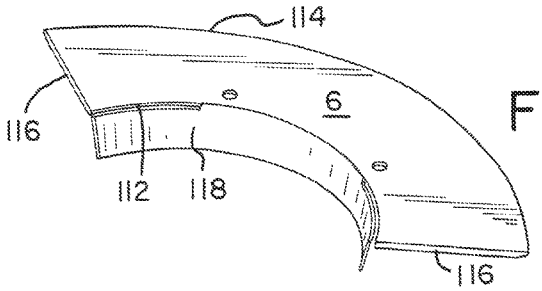
FIG. 20

FIG. 24
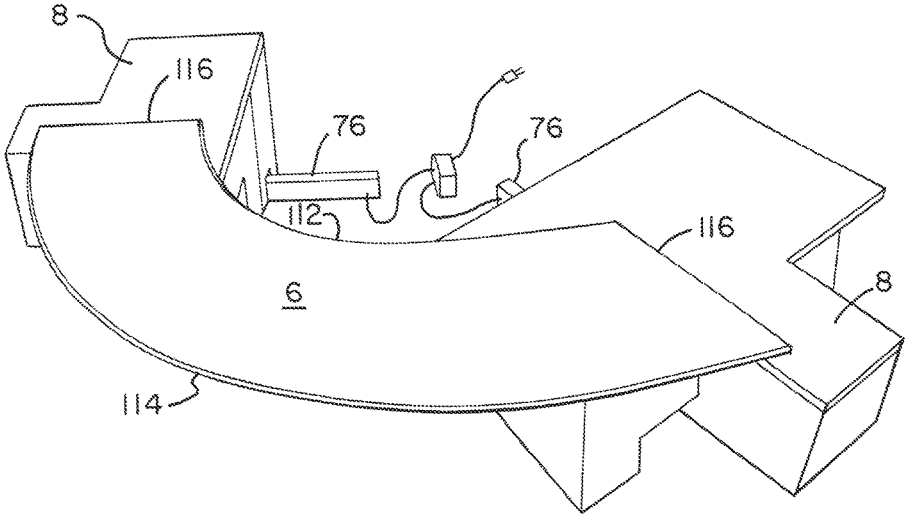
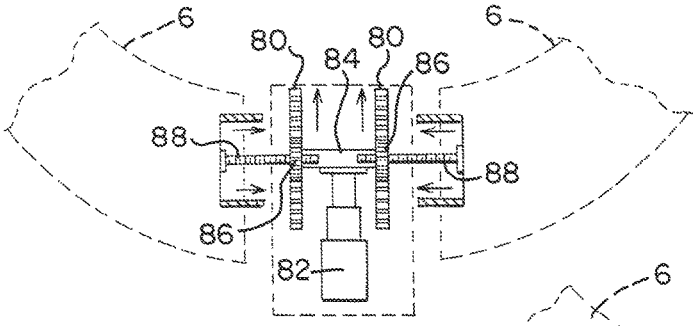
FIG. 25B
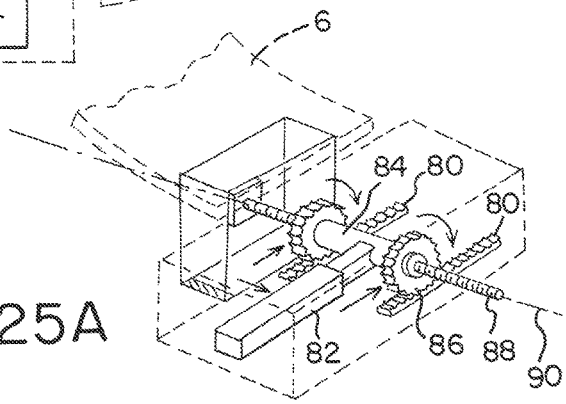
FIG. 25A

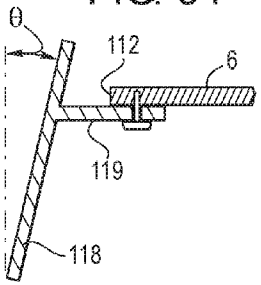
FIG. 34
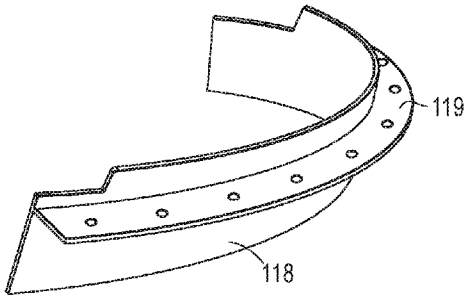
FIG. 33
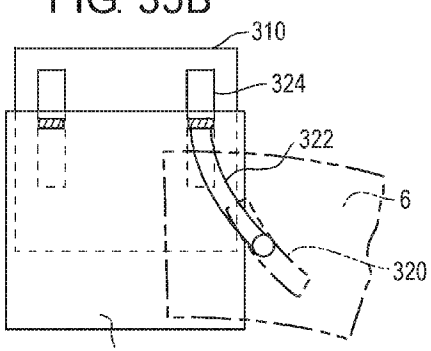
FIG. 35C
FIG. 35B
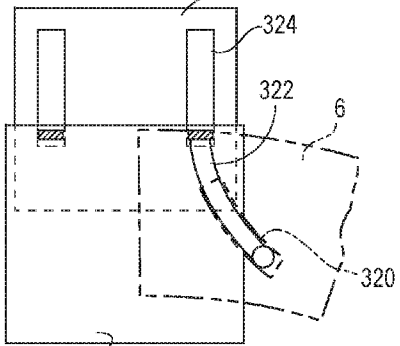
FIG. 35A

RECONFIGURABLE CONFERENCE TABLE

This application claims the benefit of U.S. Provisional Application No. 62/323,029, filed Apr. 15, 2016, the entire disclosure of which is hereby incorporated herein by reference.

FIELD OF THE INVENTION

The present application relates generally to a reconfigurable conference table, and in particular to a conference table that may be expanded and/or contracted, and to methods for the use and assembly thereof.

BACKGROUND

Conference and meeting rooms are often configured with elongated rectangular tables. Such a setting may limit the ability of the participants to interface with other participants situated on the same side of the table. Moreover, such tables, which typically include a seat at the end of the table, or have seating on opposite sides of the table, may not be desirable in non-hierarchal and/or non-adversarial settings, for example when collaboration and team building is important. In addition, such tables are not readily adaptable to host or integrate telepresence participants, who are typically grouped on a single screen and allocated to one end of the table.

While round conference tables may satisfy some of these shortcomings by providing a more democratic setting, such tables present their own set of limitations. For example, round tables large enough to accommodate a relatively large group of participants have a large footprint that may be unappealing and feel cavernous for a smaller group. Typically, however, such tables either are not reconfigurable to a smaller footprint, or require complex and time consuming reconfiguration with the installation of various leaves and fillers. In addition, round tables also present problems for telepresence participants, with screens typically positioned either behind or between participants. In either case, the screens may interrupt and/or defeat the collaborative environment.

SUMMARY

Nothing in this section should be considered to be a limitation on the following claims.

In one aspect, one embodiment of a reconfigurable conference table includes at least three circumferentially spaced support nodes radially spaced from a center axis. At least two of the support nodes are moveable toward and away from the center axis, with the at least three support nodes thereby being repositionable between contracted and expanded configurations. At least three worksurface sectors are moveably supported by adjacent pairs of the nodes. Each worksurface sector has an upper worksurface, opposite ends and radially spaced inner and outer edges, with the inner edges defining a center opening there between. Adjacent ends of each pair of worksurface sectors are movable toward and away from each other as the at least three support nodes are repositioned between the contracted and expanded configurations. The size of the center opening is changed as the worksurface sectors are moved toward and away from each other.

In one embodiment, each support node includes a first monitor positioned above the upper worksurfaces of the worksurface sectors. The first monitors each face one of the worksurface sectors disposed across the center opening from the support node. In addition, each support node may also include a second monitor positioned below the upper support surfaces of the worksurface sectors. The second monitors each face one of the worksurface sectors disposed across the center opening from the support node.

In another aspect, one embodiment of a reconfigurable conference table includes an annulus shaped worksurface having a continuous, unbroken upper surface and radially spaced inner and outer peripheral edges. The inner peripheral edge defines a center opening. The worksurface is moveable between a contracted configuration and an expanded configuration, with the outer peripheral edge having a first length in the contracted configuration and a second length in the expanded configuration, and with the second length being greater than the first length. The upper surface is maintained continuous and unbroken as the worksurface is moved between the contracted and expanded configurations.

In yet another aspect, one embodiment of a method for adjusting the configuration of a conference table includes radially spacing at least three support nodes relative to a center axis in an expanded configuration, wherein the three support nodes are circumferentially spaced relative to each other. The method also includes supporting at least three worksurface sectors with the at least three support nodes, wherein each sector has an upper worksurface, opposite ends and radially spaced inner and outer edges. The inner edges define a center opening there between. Each of the support nodes supports adjacent ends of a pair of worksurface sectors. The method further includes moving at least two of the support nodes toward the center axis and thereby repositioning the at least three support nodes in a contracted configuration, and moving the adjacent ends of each of the pairs of sectors toward each other and thereby diminishing the size of the center opening. In another aspect, the method further includes moving at least two of the support nodes away from the center axis and thereby repositioning the at least three support nodes in an expanded configuration, and moving the adjacent ends of each of the pairs of sectors away from each other and thereby increasing the size of the center opening.

The various embodiments of the conference table and methods of use and assembly provide significant advantages over other conference tables. For example and without limitation, the conference table provides a circular setting promoting equidistant and equal participation by all participants seated at the table. In addition, the conference table may be quickly and easily reconfigured to accommodate different participant group sizes. At the same time, the conference table seamlessly integrates telepresence, providing virtual participants with a "seat" at the table, which is easily viewed by the live participants but does not interfere with cross-table viewing.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

BRIEF DESCRIPTION OF THE DRAWINGS

FIG. 5 is a top perspective view of one embodiment of a support node.

FIG. 6 is a bottom perspective view of the support node shown in FIG. 5.

FIG. 7 is a top view of the support node shown in FIG. 5.

FIG. 8 is a front view of the support node shown in FIG. 5.

FIG. 9 is a side view of the support node shown in FIG. 5.

FIG. 16 is a bottom perspective view of a worksurface sector with a pair of guides.

FIG. 17 is a front view of the worksurface sector shown in FIG. 16.

FIG. 18 is a bottom view of the worksurface sector shown in FIG. 16.

FIG. 19 is a top view of the worksurface sector shown in FIG. 16.

FIG. 20 is a top perspective view of the worksurface sector shown in FIG. 16.

FIG. 24 is a partial perspective vie of a worksurface sector supported by a pair of adjacent support nodes FIGS. 25A and B are views of an alternative drive mechanism.

FIG. 33 is a rear perspective view of one embodiment of a privacy screen.

FIG. 34 is a cross-sectional view showing a privacy screen mounted to a worksurface.

FIGS. 35A-C are partial top views of another embodiment of a conference table worksurface and support node.

DETAILED DESCRIPTION OF THE PRESENTLY PREFERRED EMBODIMENTS

Definitions

It should be understood that the term "plurality," as used herein, means two or more. The term "coupled" means connected to or engaged with, whether directly or indirectly, for example with an intervening member, and does not require the engagement to be fixed or permanent, although it may be fixed or permanent.

The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components.

Figure 1:
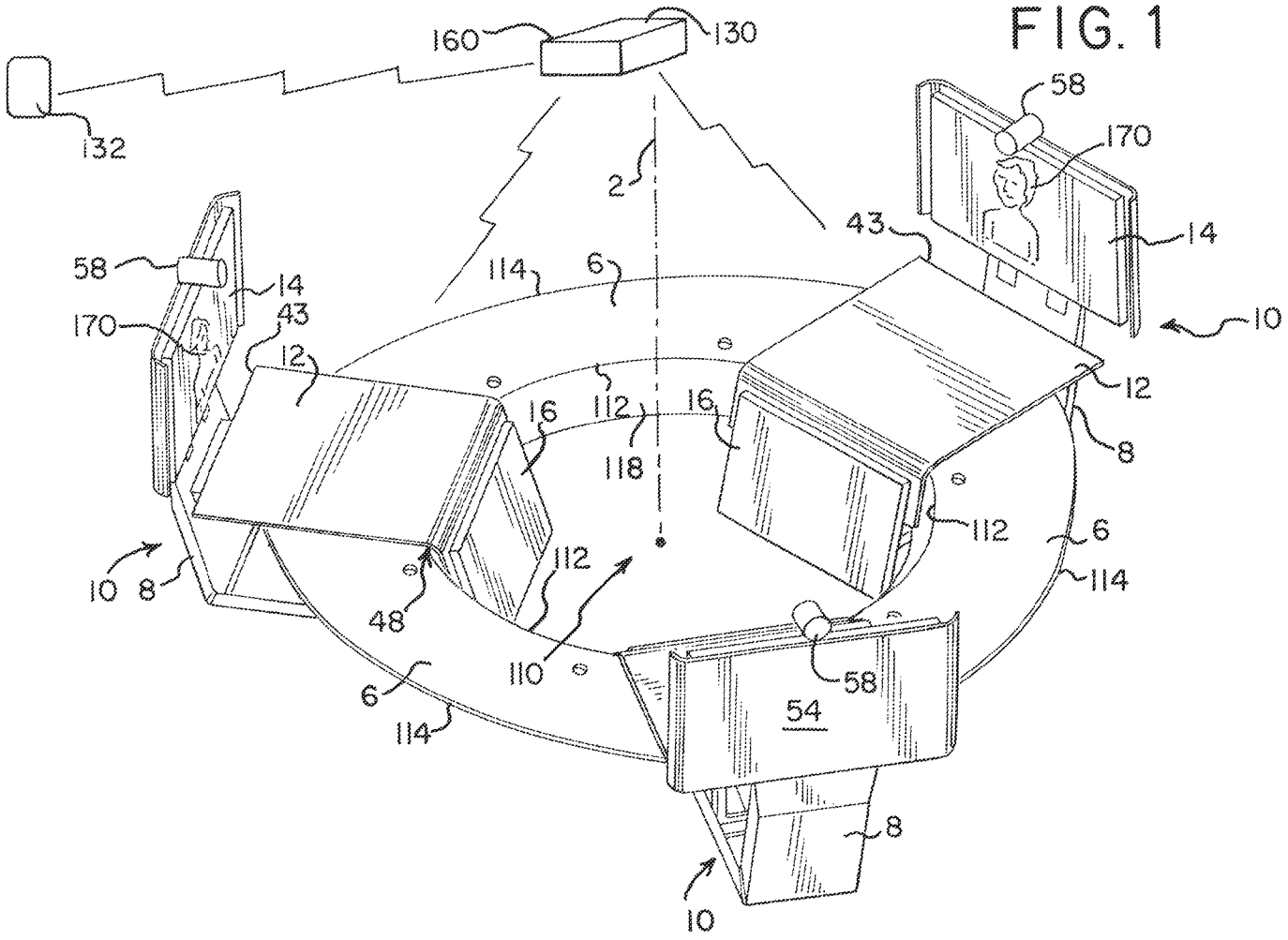
FIG. 1 is a perspective view of one embodiment of a conference table in a contracted configuration.
Figure 2:
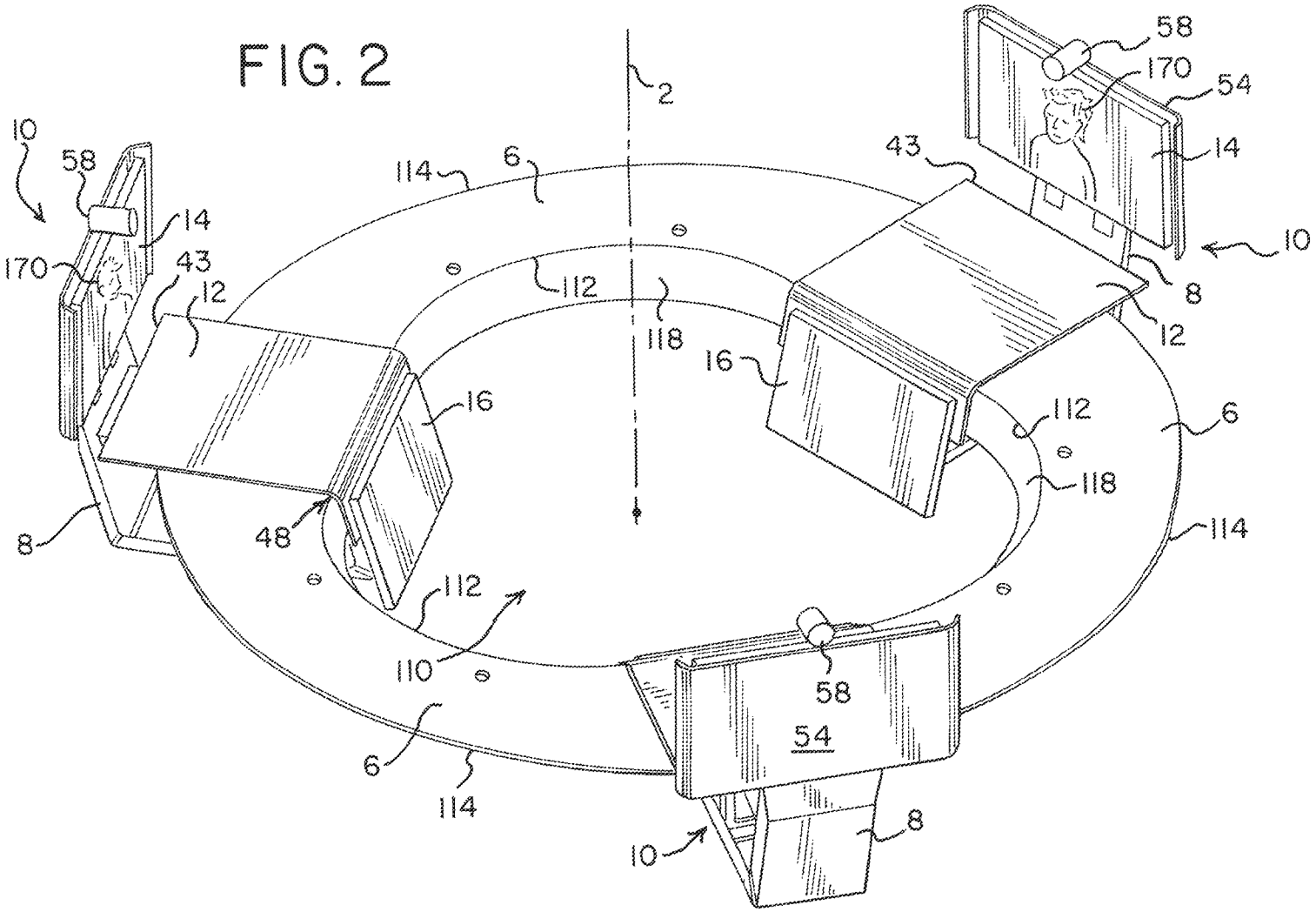
FIG. 2 is a perspective view of the conference table, shown in FIG. 1, in an expanded configuration.
Figure 3:
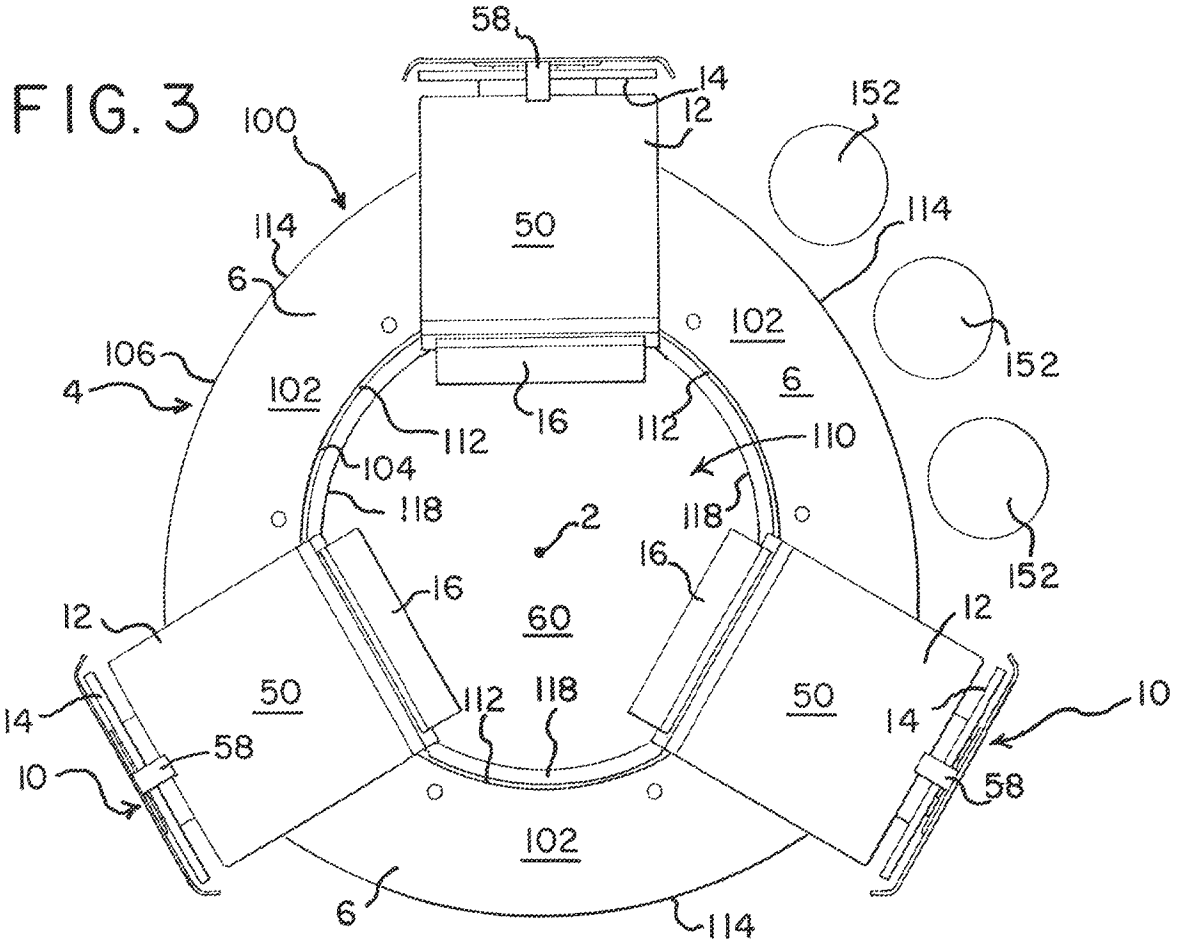
FIG. 3 is a top view of the conference table shown in FIG. 1.
Figure 4:
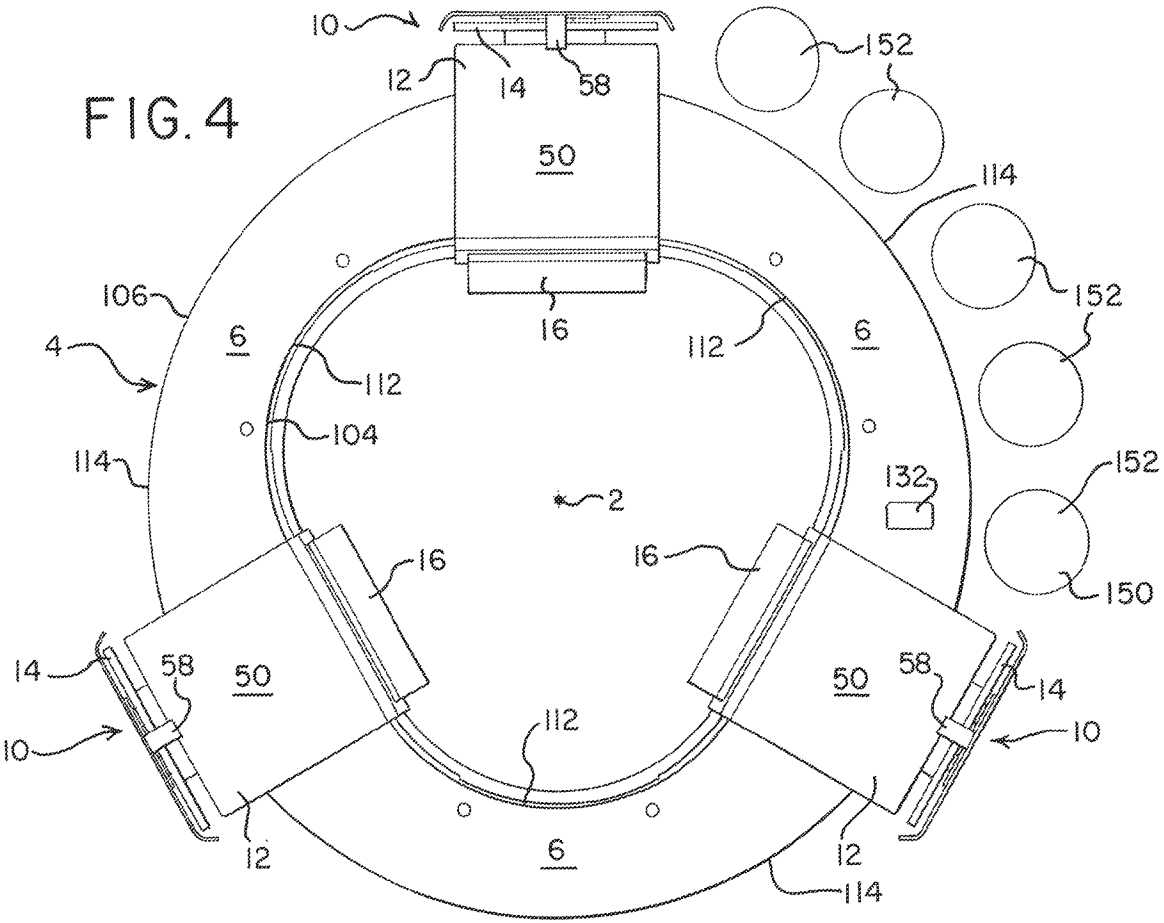
FIG. 4 is a top view of the conference table shown in FIG. 2.
Figure 10:
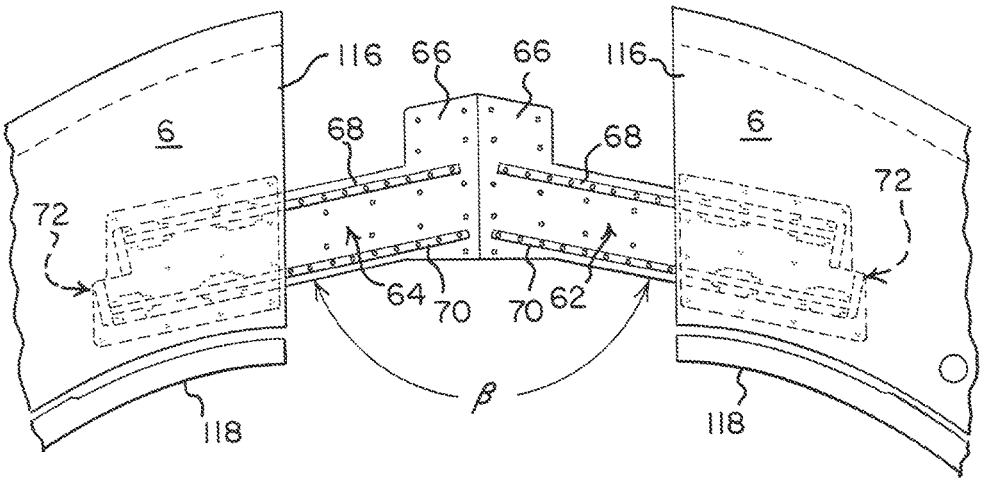
FIG. 10 is a partial, enlarged top view showing first and second tracks supporting a pair of worksurface sectors.

The terms "inner," "outer," "above," "front", "rear", "side", "vertical" and "horizontal", and variations thereof, refer to a worksurface 4 positioned relative to a center axis 2 as shown in FIGS. 3 and 4, for example with a worksurface sector 6 being positioned "vertically" above a support node base 8. The terms "rotate" and "pivot" refer to moving or turning about an axis or center point. The term "translate" refers to shifting a component from one location to another, with or without pivoting or rotating the component. The term "radial" means to project outwardly from a center axis. The terms "circumference," or "circumferential," and variations thereof, refer to a closed curve extending around a center point, such that two components being "circumferentially spaced" are spaced apart along the closed curve. The phrases "reuleaux triangle" or a "reuleaux triangular shape" refer to a shape formed by the intersection of three curves, each of which may be, but are not necessarily, an arc of a circle, and which may, but not necessarily, have a center on the boundary of the other two. The reuleaux triangle may be formed, for example, by rounding the sides of an equilateral triangle, or by three intersecting circles. The phrases "continuous" and "unbroken" mean there are no gaps or breaks in the shape of the component(s) when projected onto a plane, such that a plurality of overlapping components may define a continuous, unbroken surface.

Support Nodes

Referring to FIGS. 1-10, 13, 15 and 21A-C, a support node 10 includes a base 8, a shroud 12, and first and second monitors 14, 16. In one embodiment, the base 8 includes a frame 20, having a pair of side frame members 22, a front portion 24, a rear portion 26, and an upper portion 28. The upper portion has a pair of wings 30, or shoulders extending laterally outwardly from the side frame members 22. The wings 30 may be configured with a plurality of ribs 32. The side frame members are spaced apart to define a cavity 34 there between, which may be partitioned with one or more shelves 36, and/or closed on opposite sides. A controller 130 may be positioned in the cavity. The controller may include a central processing unit, having a processor, which is programmed to control the movement of the support nodes as further explained below, as well as control the communication links and systems associated with monitors 14, 16 and camera 58. The front and rear frame portions 24, 26 may be oriented at an angle α relative to a vertical plane 38. In various embodiments, a may be between 10 and 30 degrees, and is preferably about 17 degrees. The base may be made of various materials, including without limitation metal, plywood, plastic and/or combinations thereof.

Referring to FIGS. 1-9, the shroud 12 has a front portion 40 that runs parallel to, and is spaced forwardly from, the front portion 24 of the frame, and an upper portion 42 running parallel to and spaced above the upper portion 28 of the frame. The upper portion 42 has a rear edge 43. The front and upper portions 40, 42 may be integrally formed, joined at a curved corner 44, or formed separately. The front portion 40 of the shroud 12 is coupled to the front portion 24 of the frame with a forwardly extending support member 46 at a location spaced below a top surface of the base, such that a continuous, generally L-shaped cavity 48 or gap is formed between the underside of the shroud front and upper portions 40, 42 and the outer surface of the front and upper portions 24, 28 of the base. The cavity 48 is continuous, meaning there are no obstacles extending between the shroud 12 and base 8 along the length of the cavity. In one embodiment, however, it should be understood that the shroud may be connected to the base along a centerline 18 thereof, with continuous cavities extending outwardly from the centerline. An upper surface 50 of the upper portion of the shroud defines a worksurface. The shroud 12 may be made of various materials, including metal, such as aluminum, wood, plastic or combinations thereof. As further explained below, the shroud covers the ends of the worksurface sectors 6 in both the contracted and expanded configurations, and thereby provides a continuous annulus shaped worksurface in combination with the sectors.

The rear portion 26 of the base frame includes an upright member 52 that extends, in one embodiment, along the vertical plane 38. The upright 52 may include passageways 53 to accommodate and route various cables and cords running to the monitor 14. The first monitor 14 is coupled to the upright member 52 and has a viewing screen facing inwardly toward the center axis 2. A shroud 54 may be secured to the upright and cover the rear of the monitor, with side wings 56 wrapping around the sides of the monitor. A camera 58 may be secured to the upright member, for example, above the monitor, with the camera directed at the center axis 2, and at participants 152 seated across from the camera.

The second monitor 16 is coupled to the support member 46, and is oriented at the angle α, or some other suitable angle, such that the participants seated across from the second monitor 16 may more easily view the monitor 16. Utilities for the monitors, camera and controller may be managed and stored in the base 8, wherein they may be further routed to outlets and/or raceways provided in the floor 60.

The upper portion 28 of the base frame, including the wings 30, provides a platform for first and second tracks 62, 64, which extend laterally outwardly from the base 8. The tracks may be supported by, or formed on, one or more platforms 66. The first and second tracks are oriented at an angle β, which may be between 130 and 170 degrees, more preferably between 150 and 160 degrees, and preferably 156 degrees in one embodiment. The platforms 66 may be coupled to the base with a plurality of fasteners. The first and second tracks 62, 64 may be each formed by a pair of rails 68, 70, or may include only a single rail. Alternatively, the tracks may be formed by a recess in the platform. The rails, and recess, may be configured with a cross-sectional profile, e.g., oval, elliptical or T-shaped. The ends 72 of the platform are stepped to accommodate different length rails 68, 70, with a first rail 70 having a greater length than a second rail 68, which provides additional leg room when the conference table is in a contracted configuration. It should be understood that the first and second rails may be same lengths, or the first rail may be shorter than the second rail.

The base 8 includes a floor transition interface 74. In various embodiments, the floor transition interface may include one or more wheels, rollers or glides (e.g., rails), or combinations thereof. For example, as shown in FIGS. 6, 8 and 9, in one embodiment, a plurality (e.g., fourteen) of wheels 75 supports the base.

At least one of the support nodes 10 includes an actuator 76. In one embodiment, the actuator is anchored to the floor 60 and is coupled to the base 8. The actuator 76 is moveable between at least first and second positions, and in one embodiment, is infinitely adjustable between the first and second positions, for example at various intermediate positions. In one embodiment, the actuator is configured as a linear actuator, for example a pneumatic, hydraulic or electro-mechanical actuator, such as a servo driven screw or a two-stage cylinder. The linear actuators may be extended or contracted to move the support node 10 toward or away from the center axis 2. In various embodiments, one, two or three of the support nodes 10 are provided with a linear actuator 76. In various embodiments, as shown in FIGS. 6 and 24, the linear actuators may be hidden entirely beneath the support node, or may extend forwardly therefrom into the center opening.

In an alternative embodiment, shown in FIGS. 25 A and B, the support node 10 may include a drive mechanism 78. The drive mechanism interfaces between the support node 10 and a worksurface sector 6, rather than between the support node and floor. The base 81 of the support nodes may remain stationary relative to the floor, with the worksurface segments 6 moving toward and away from each other, while also moving radially inwardly and outwardly. For example, in one embodiment, the drive mechanism includes a pair of linear gears 80, or racks, supported by the upper portion of the base. An actuator 82 is coupled to an axle 84, supporting a pair of drive gears 86, which interface with the linear gears. The actuator 82 is moveable between first and second positions, so as to translate the axle 84 and rotate the drive gears as the drive gears 86 interface with the linear gears 80. A drive spindle 88 is threadably engaged with each drive gear, and is caused to move along an axis 90 relative to the drive gears as they rotate. The drive spindles are rotatably coupled to a pair of adjacent worksurface sectors 6, causing the sectors 6 to move toward or away from each other as the spindles 88 move linearly along axis 90.

In other embodiments, the support nodes may be moved by linear guides and tracks, cables and/or pulleys, rack and pinion gear systems and other known translation inducing systems. Alternatively, the support nodes may be moved manually, simply by a user pushing and/or pulling the support nodes.

Figure 26A:
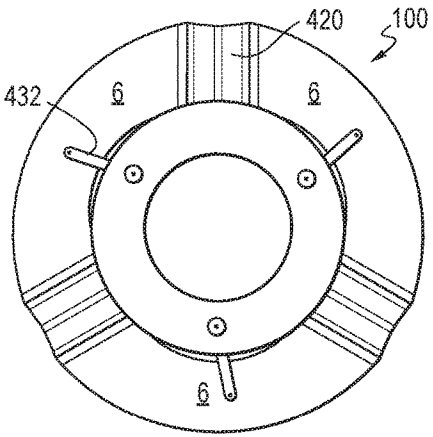
FIGS. 26A and B are top views of another embodiment of a conference table in expanded and contracted configurations.
Figure 26B:
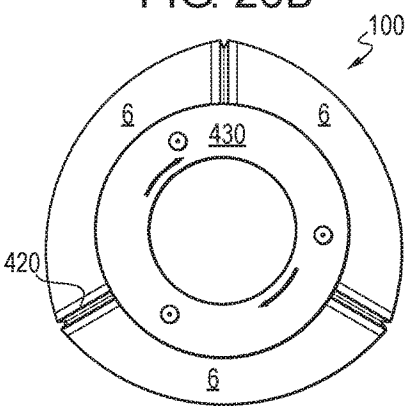
Figure 30:
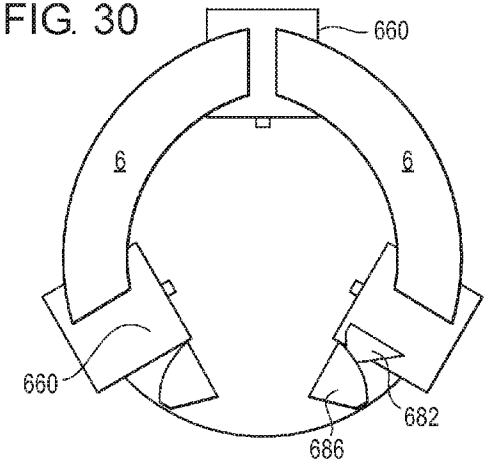
FIG. 30 is a partial top view of another embodiment of a conference table with only two worksurface sectors shown.
Figure 32:
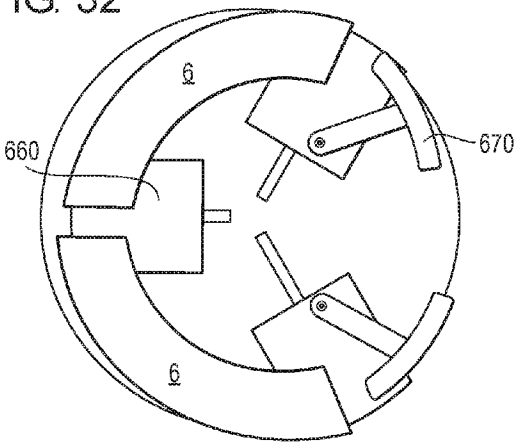
FIG. 32 is a partial top view of another embodiment of a conference table with only two worksurface sectors shown.
Figure 29:
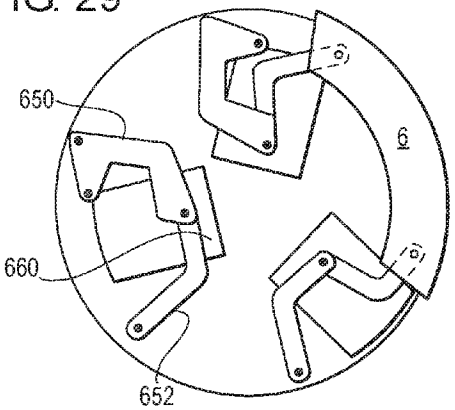
FIG. 29 is a partial top view of another embodiment of a conference table with only one worksurface sector shown.
Figure 31:
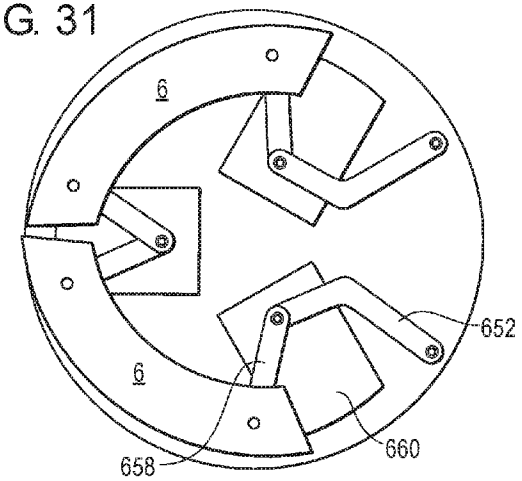
FIG. 31 is a partial top view of another embodiment of a conference table with only two worksurface sectors shown.

For example, as shown in FIGS. 26A-28B and 36, the ends 116 of the worksurface segments 6 may be joined by a hinge components 420, 520, 522 extending downwardly, or inwardly, from the worksurface 100 and opening or closing to move the worksurface 100 between expanded and contracted configurations. In one embodiment (FIGS. 26A-228B), the hinge component 420 has a horizontal pivot axis, while in the embodiment of FIG. 36, the hinge components 520, 522 have a vertical pivot axis, defined for example by relative apices that move vertically, or horizontally respectively. The worksurface segments 6 shown in FIG. 36 may be joined by a single hinge component 520. As shown in FIGS. 26A and B, a drive mechanism, for example a ring 430, may be coupled to the worksurface segments 6 with one or more links 432. Rotation of the ring 430 causes the links 432 to move the worksurface segments 6 and hinges 420 relative to each other between contracted and expanded configurations.

In other embodiments, shown in FIGS. 29-32, various linkage systems, including first and second links 650, 652, 658, 670, 682, 686 or cams, are pivotally connected between each support node 660 and respective ends of adjacent worksurface segments 6. Other linkage systems may have more than one link or cam disposed between each worksurface segment and support node. In various systems, one or more of the support node(s) may move or remain stationary.

In yet another embodiment, shown in FIGS. 35A-C, a support node 310 includes a track 324. A shroud 312 moves radially inwardly and outwardly relative to the support node 310, or the support node moves relative to the shroud. A link 322 is pivotally coupled to the shroud 312, and has an end portion that moves along the track. An opposite end portion of the link 322 moves within a track 320 disposed on the worksurface segment 6. As the shroud 312 and support node 310 move relative to each other, the link 322 moves within the tracks 324, 320, such that the worksurface segments 6 are moved relative to the support node 310, and each other, between a contracted configuration (FIG. 35A), intermediate configuration (FIG. 35B) and expanded configuration (FIG. 35C). The support node 310 may remain stationary, with the shroud 312 moving, or the support node(s) 310 may move relative to the shrouds 312.

Figure 37:
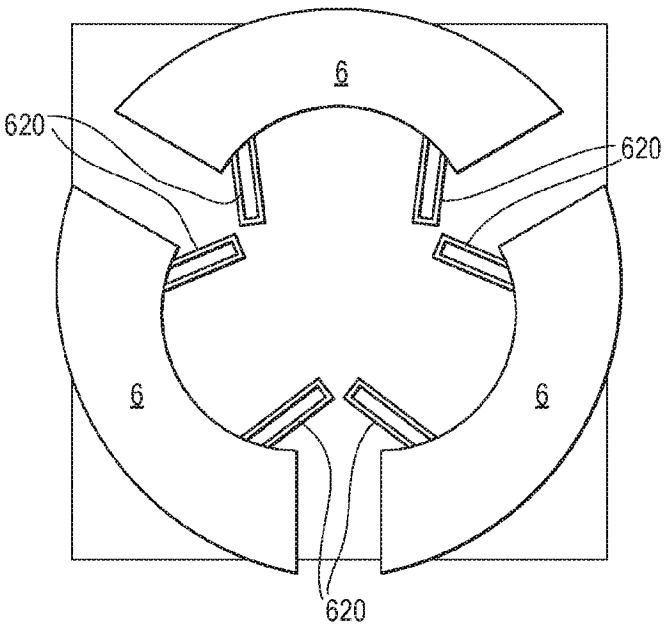
FIG. 37 is a top view of another embodiment of a conference table.
Figure 36:
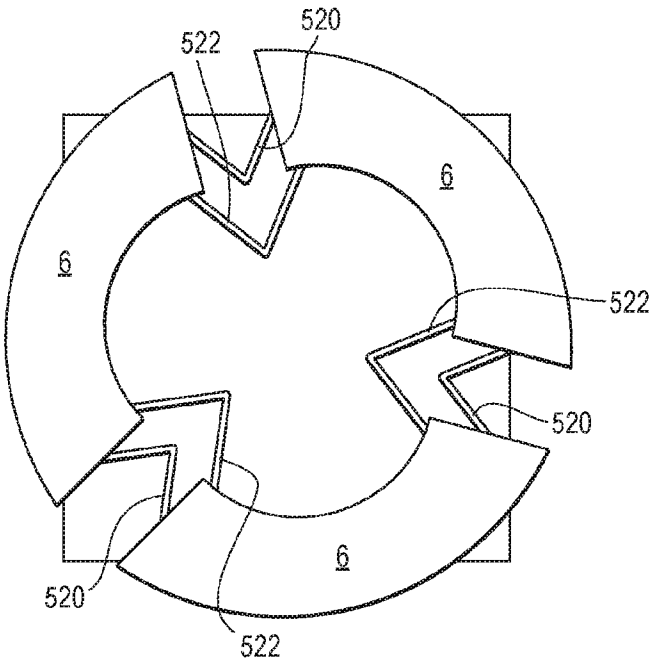
FIG. 36 is a top view of another embodiment of a conference table.

In yet another embodiment, shown in FIG. 37, each of the worksurface segments 6 may translate along a pair of tracks 620 forming a support node.

Worksurface

Referring to FIGS. 1-4 and 10-21C, an annulus shaped worksurface 100 includes a plurality of worksurface sectors 6 (shown as three) and a plurality of shroud worksurfaces 50 (shown as three). When projected upwardly onto a horizontal plane, upper worksurfaces 102 of the sectors and shroud worksurfaces 50 define a continuous, unbroken upper surface (see FIGS. 3 and 4). The shroud worksurfaces 50 cover the ends 116 of the worksurface sectors 6 in all configurations, thereby providing continuity to the overall worksurface 100. The annulus shaped worksurface has radially spaced inner and outer peripheral edges 104, 106, with the inner peripheral edge defining a center opening 110. The inner and outer edges 104, 106 of the overall worksurface are defined by the sectors and the edge 43 and corner 44 of the shrouds in combination. Specifically, each sector has an individual upper worksurface 102, radially spaced inner and outer edges 112, 114 and opposite ends 116. The outer edges 114 may be chamfered on an underside of the sector 6. The inner edges 112 forming a portion of the inner peripheral edge 104 defining the center opening 110. In one embodiment, each worksurface sector 6 has a first width (W1) defined between the inner and outer edges 112, 114 at each end of the sector, and a second width (W2) defined between the inner and outer edges 112, 114 at a midpoint between the ends of the sector. The first width (W1) is greater than the second width (W2).

Figure 11:
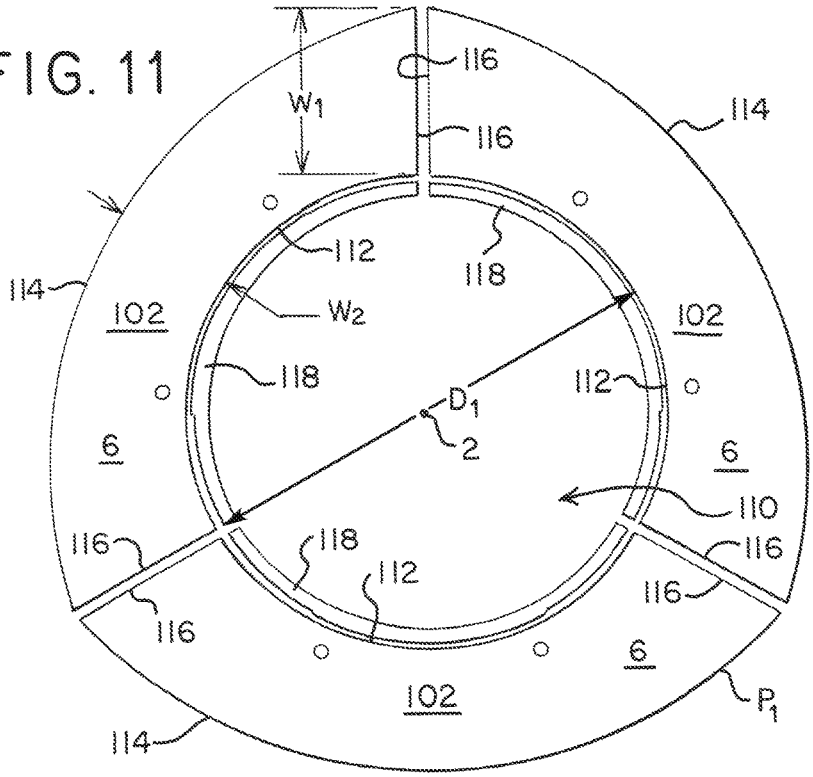
FIG. 11 is a top view of three worksurface sectors in a contracted configuration.
Figure 12:
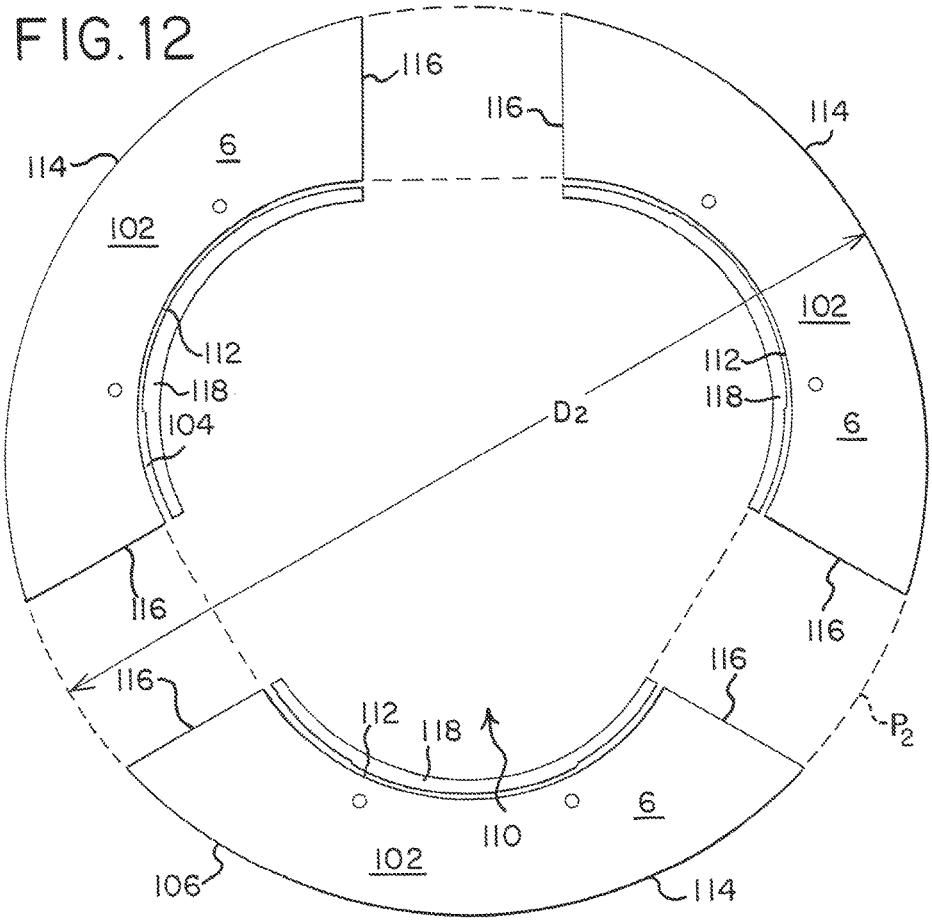
FIG. 12 is a top view of the three worksurface sectors, shown in FIG. 11, in an expanded configuration.

Adjacent ends 116 of pairs of the worksurface sectors 6 are moveable toward and away from each other between the base 8 and the shroud upper portion 42 so as to change the size of the center opening 110. In a contracted configuration, shown in FIG. 11, the center opening 110, defined by the inner edges 112 of the worksurface sectors 6, has a substantially circular shape with a diameter D1. In an expanded configuration, shown in FIG. 12, the outer edges 114 of the worksurface sectors 6 define a substantially circular shape with a diameter D2, which is greater than D1, while the inner edges 112 define a generally reuleaux triangular shape. In addition, the outer edges 114 of the worksurface sectors 6, when in a contracted configuration, define a reuleaux triangular shape, as shown in FIG. 11. It should be understood that the inner and outer edges may be made linear, or curvilinear, and that shapes other than circular or reuleaux may be achieved. An outer peripheral edge, defined by the outer edges 114 and any gap between adjacent outer edges, has a first length P1 in the contracted configuration (FIG. 11) and a second length P2 in the expanded configuration (FIG. 12), with the second length P2 being greater than the first length P1. The upper surface is maintained continuous and unbroken as the worksurface, defined by the segments 6 and the shroud 50, is moved between the contracted and expanded configurations.

Each worksurface sector 6 may be configured with a privacy shield 118, otherwise referred to as a modesty panel, which extends downwardly and inwardly from the inner edge 112 of a corresponding sector 6. As shown in FIGS. 33 and 34, a mounting plate 119 extends radially, and substantially horizontally from a rear surface of the privacy shield 118, and is secured to an underside of the worksurface sector 6, with the privacy shield 118 being spaced apart from the inner edge 112. The privacy shield 118 and worksurface sector 6 are oriented relative to each other, for example and without limitation, at angle θ, and have thicknesses dimensioned such that they may be received in the gap 48 between the shroud 12 and base 8. The orientation θ and spacing of the privacy shield 118 relative to the worksurface segment 6 may be varied along the length thereof depending on the interface with the support node 10, the monitor 16, and in particular the shroud 12, including the spacing and position of the front portion 40 relative to the frame front portion 12. In one embodiment, the privacy shield 118 has a conical shape, and may not present a constant gap or spacing relative to the front portions 12, 40, but rather moves between the gap presented therebetween. In one embodiment, θ may approximate a for at least a portion of the privacy shield 118. The worksurface sectors may be made of a medium density particle board with a laminate top and standard backer.

Figure 13:
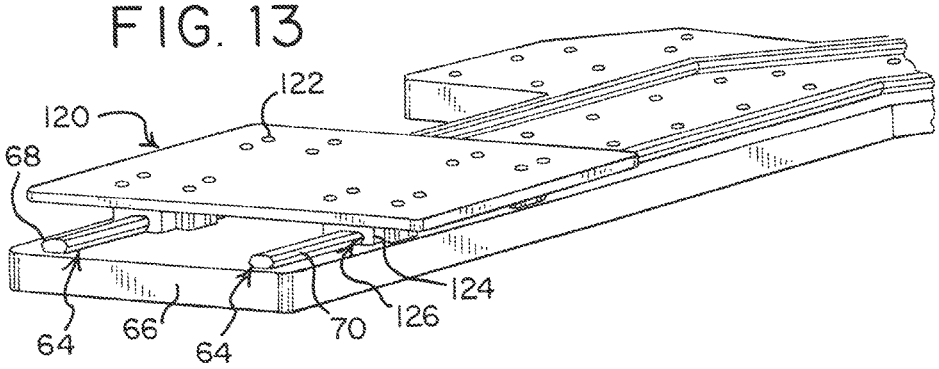
FIG. 13 is a perspective view of a track supporting a guide.
Figure 14:
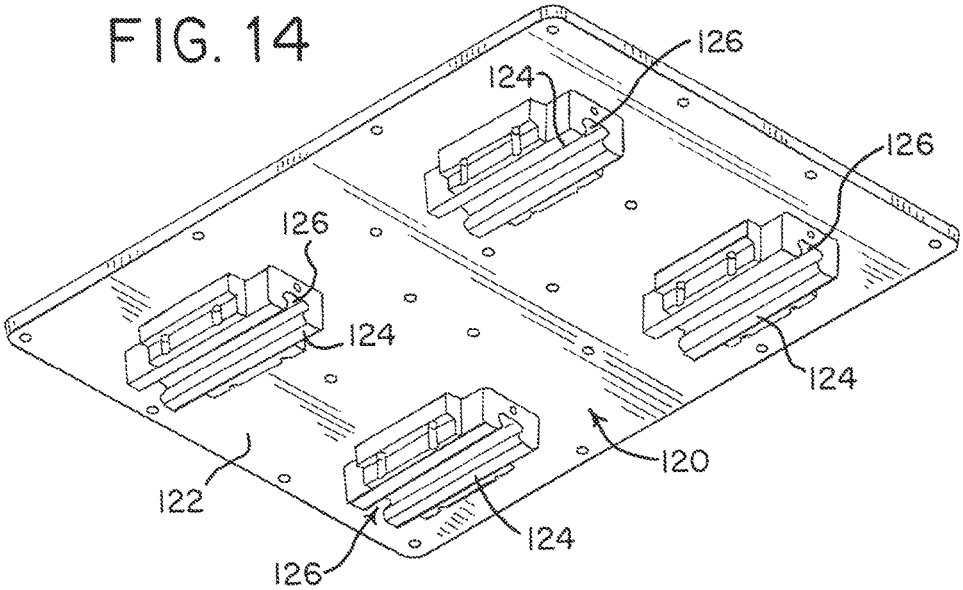
FIG. 14 is a bottom perspective view of one embodiment of a guide.
Figure 15:
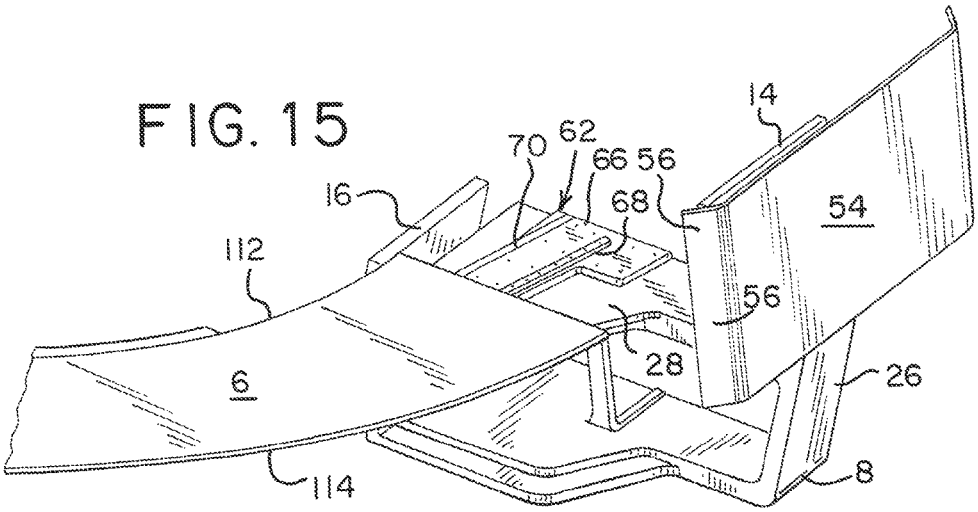
FIG. 15 is a partial, perspective view of a support node and a worksurface sector.

Each end of each sector 6 has a guide 120 coupled to the bottom surface thereof. Each guide includes a platform 122 connected to the sector 6, for example with fasteners, and a plurality of guide members 124 (shown as four). Each guide member 124 has a channel 126 with a profile shaped to receive one of the first or second rails of a corresponding track, as shown in FIG. 13.

Assembly

As shown in FIGS. 1-4, 10, 13, 15 and 21A-C, the support nodes 10 are circumferentially spaced apart relative to each other, and are radially spaced from a center axis 2. Opposite ends 116 of each worksurface sector 6 are moveably supported by adjacent pairs of the support nodes 10, with each support node moveably supporting adjacent ends 116 of a pair of worksurface sectors 6. For example, the guide members 124 secured to the worksurface sectors are engaged with the rails 68, 70 supported by the support nodes. It should be understood that the worksurface sectors could alternatively be configured with rails, and the support nodes with guide members.

In one embodiment, each of the support nodes 10 includes an actuator 76 anchored to the floor 60, with each support node being moveable on the floor. Alternatively, at least two of the support nodes are configured with actuators and moveable, with the third support node remaining stationary. The stationary support node may be anchored to the floor.

The actuators 76, whether anchored to the floor or situated on the support node beneath the sectors, may be linked to a center controller 130, whether by hard wire or wirelessly. The central controller 130 includes a central processing unit, having a processor, which is programmed to control the movement of the support nodes, as well as control the communication links and systems associated with monitors 14, 16 and camera 58. Alternatively, each actuator may include an individual controller 131. The central controller 130 may be located in one of the support nodes, or supported remotely, for example overhead or in/on a nearby wall or floor. A remote control device 132, or user interface, including for example and without limitation a mobile device such as a smart phone, tablet or other interface, may wirelessly communicate with a center controller 130, which then communicates with the individual controllers 131 or actuators, or wirelessly communicate directly and collectively with the individual controllers 131 associated with each node, and send a signal to effect an actuation of the linear actuators 76, 82 or other drive mechanisms configured to move the support nodes.

Figure 22:
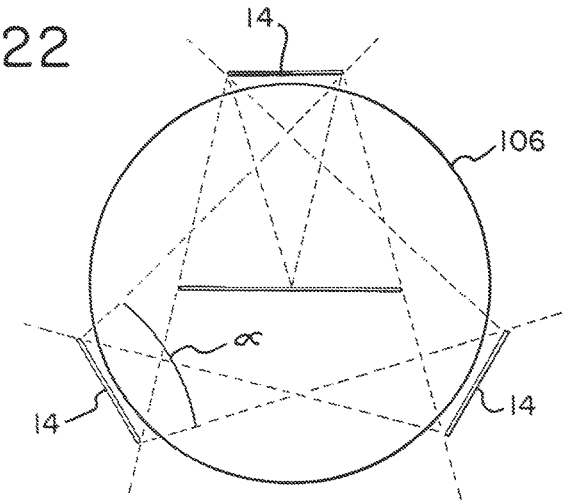
FIG. 22 is a schematic view showing sight lines and viewing angles for monitors located on the support nodes.
Figure 23:
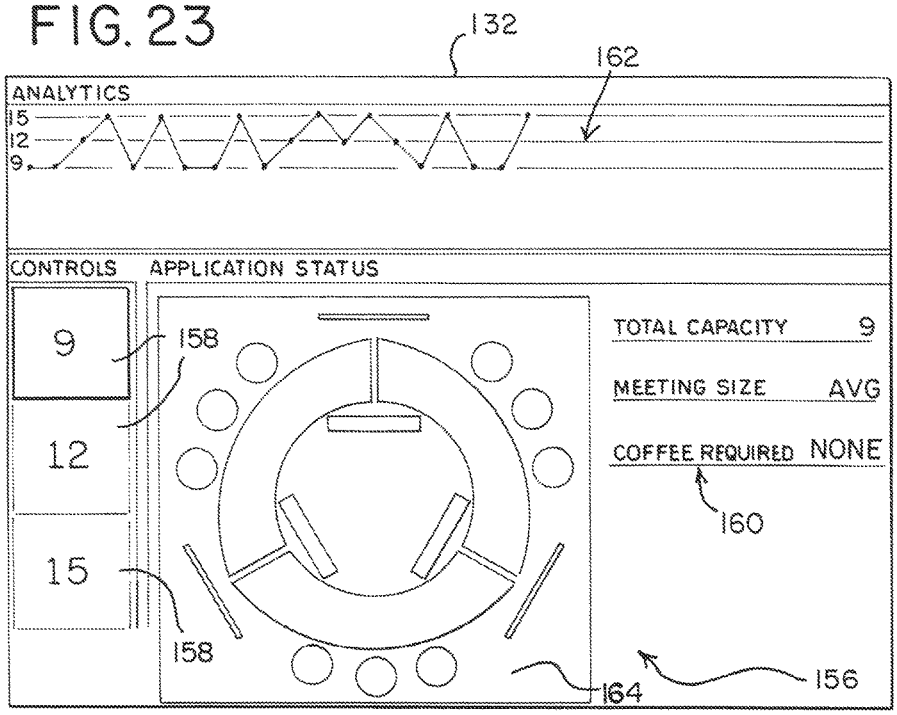
FIG. 23 is one embodiment of controller displaying a graphical user interface.
Figure 28A:
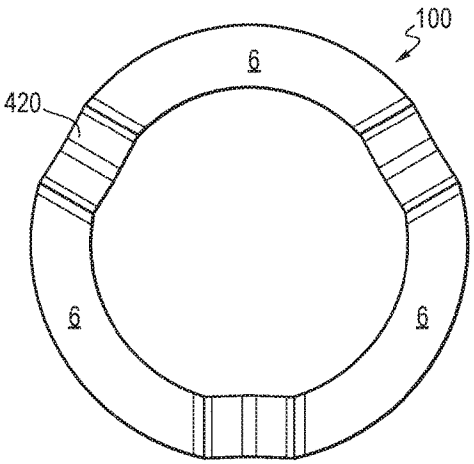
FIGS. 28A and B are top views of another embodiment of a conference table in expanded and contracted configurations.
Figure 28B:
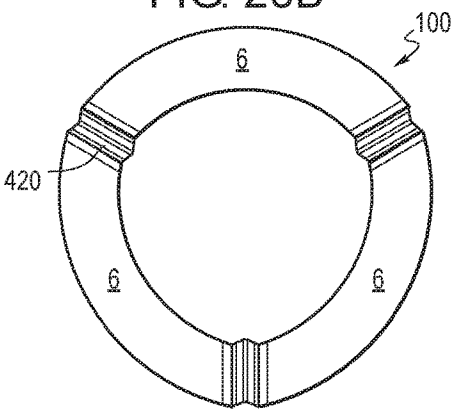
Figure 27A:
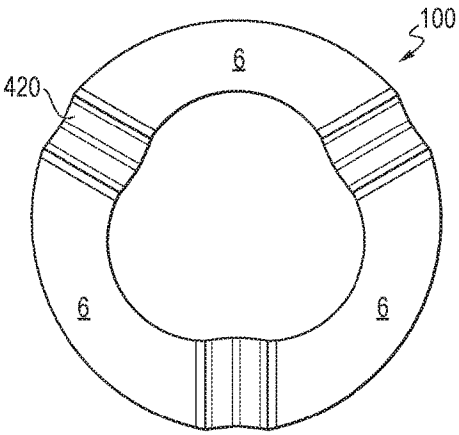
FIGS. 27A and B are top views of the conference table shown in FIGS. 26A and B without a drive mechanism.
Figure 27B:
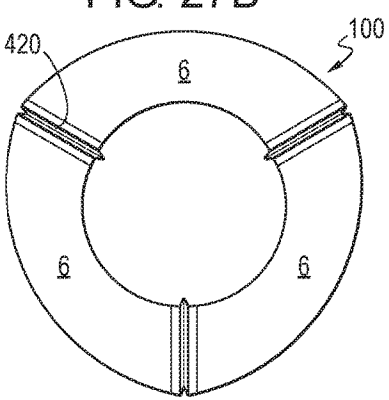

The first monitors 14 associated with each node are positioned above the upper worksurfaces 102 of the worksurface sectors, for example on the upright 52 of the rear frame member 26. The first monitors 14 face inwardly toward the center axis 2 and one of the worksurface sectors 6 disposed across the center opening 110 from the corresponding support node. Likewise, the second monitor 16, which is angled upwardly, is positioned below the upper support surfaces 102 of the worksurface sectors. The second monitors 16 face inwardly toward the center axis 2 and one of the worksurface sectors 6 disposed across the center opening 110 from the corresponding support node. As shown in FIG. 22, the viewing angle σ, for example 60 degrees, associated with each monitor 14, 16 projects to encompass an oppositely positioned sector 6 and the participants arranged behind the sector. The first and second monitors 14, 16 associated with each support node are directed to the same corresponding sector.

Operation

Figure 21A:
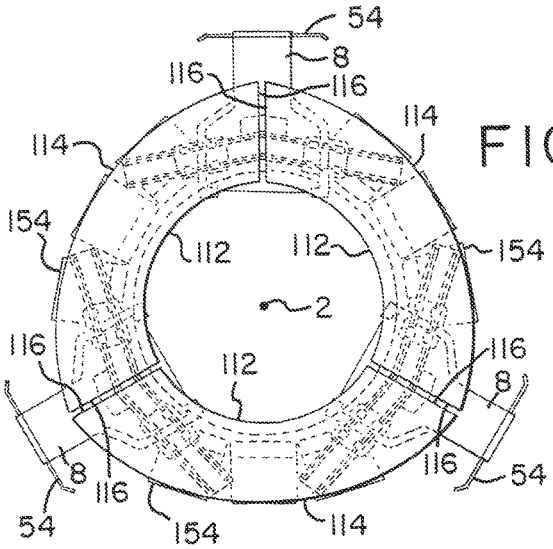
FIGS. 21A-C are top views of one embodiment of conference table without shrouds in contracted, intermediate and expanded configurations respectively.
Figure 21B:
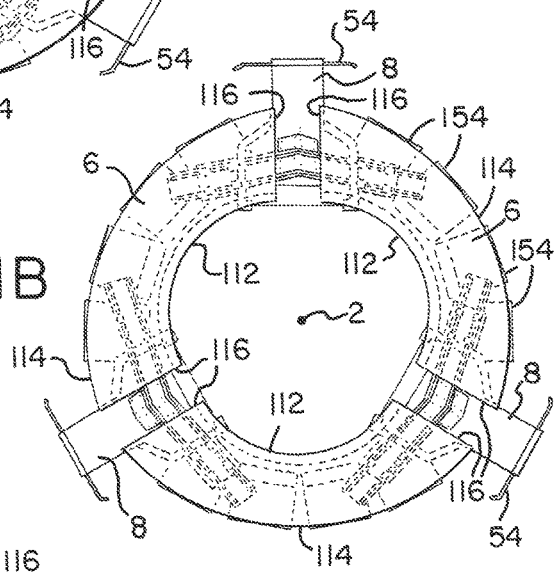
Figure 21C:
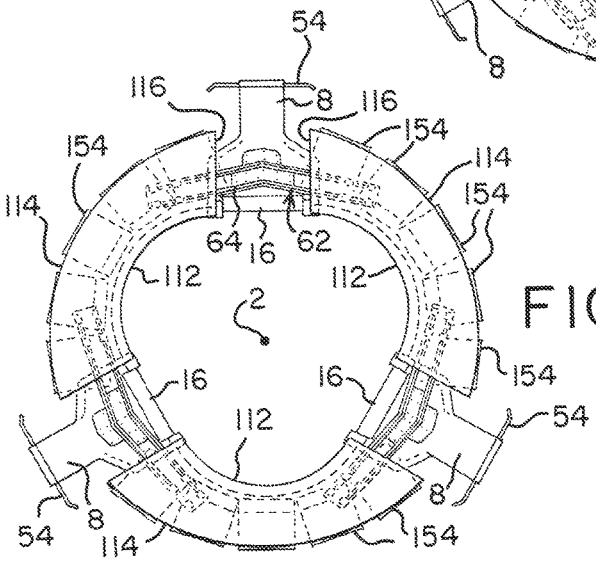

In operation, a user 150 determines what configuration he/she desires for the reconfigurable conference table. For example, as shown in FIGS. 3 and 21A, the conference table, in the contracted configuration, may accommodate three persons 152 at each worksurface sector 6, for a total of nine (9) participants. As shown in FIGS. 4 and 21C, the conference table, in the expanded configuration, may accommodate five persons at each worksurface sector 6, for a total of fifteen (15) participants. Of course, depending on the size of the chairs 154, the conference table may be reconfigured at different intermediate configurations, shown for example in FIG. 21B, where twelve participants 152 are accommodated.

Once the configuration is determined, the user 150 may use the controller 132, and graphical user interface 156, to select the predetermined configuration, for example by selecting (by touch or push button) a population icon 158. Other meeting amenities, such as food/beverage service, may also be selected using amenity icons 160 displayed on the controller. The controller 132 may also record, and provide output, as to the historical use of the conference table, which may be output as an analytic graph 162 for future space planning. The controller may also provide a graphical interface to control the room environment, including lighting, volume, temperature, etc. The controller may also provide a visual image 164 showing a population schematic for the selected conference table configuration.

The controller 132 transmits or sends a signal to the controller 130 processing unit, which then transmits or sends a signal to actuate one or more of the actuators 76, 82 or drive mechanisms. The actuators 76, 82 are moved to another position, whether to move the support nodes 10 radially inwardly or outwardly relative to the center axis 2 to another configuration. It should be understood that if one of the support nodes 10 remains stationary, then the center axis 2 also moves with the other two support nodes, while if all three support nodes are being moved, the center axis 2 remains stationary. It should also be understood that the support nodes 10 may be moved manually, for example by one or more users pushing or pulling the support nodes toward or away from the center axis.

When the conference table is going to be reconfigured, a warning indicia is capable of being activated so that persons near the system are aware that at least two of the support nodes, and associated worksurface sectors, are going to be moved. For example, the warning indicia may include an auditory, visual or tactile (e.g., vibratory) indicia, or combinations thereof. For example, a center overhead unit 161, housing for example the controller 130, may provide a visual indicia, for example a change in light color, a dimming or repetitive flashing, or combinations thereof. The center overhead unit 161 may also provide auditory indicia, such as an alarm. Tactile or vibratory indicia may also be applied to the worksurface 100 or floor 60.

Once the desired configuration is achieved, and the participants 152 are seated at the conference table, remote or virtual participants 170 may join a meeting by way of telepresence via one of the first or second monitors 14, 16. Alternatively, remote participants 170 may meet without any live participants being present. An image 170 of the remote telepresence participants may be shown on the first monitors 14, with the monitors positioned at the outer peripheral edge of the worksurface 100 proximate the same eye level as the live participants 152. In this way, the virtual participants 170 are seamlessly included in the meeting, which closely simulates a live meeting. A video or live stream camera 58 is also associated with each of the first monitors, such that the virtual participant 170 is provided with the same view of the other participants (live and virtual) as if they were participating live. The second monitors 16 may display an image, for example meeting content, including without limitations presentations, video, etc., with the three second monitors 16 ensuring that all participants are able to view the content. Likewise, the second monitors 16 are viewable by the remote participants via the cameras 58. It should be understood that any of the monitors 14, 16 may provide a virtual presence or content.

The circular arrangement of participants 152, 170, whether live or virtual, promotes equidistant and equal participation by all participants arranged around the table. In addition, the conference table may be quickly and easily reconfigured to accommodate different participant group sizes. At the same time, the conference table seamlessly integrates telepresence, providing virtual participants with a "seat" at the table, which is easily viewed by the live participants but does not interfere with cross-table viewing.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A reconfigurable conference table comprising:

at least three circumferentially spaced support nodes radially spaced from a center axis, wherein at least two of the support nodes are moveable toward and away from the center axis, and wherein the at least three support nodes are repositionable between contracted and expanded configurations as the at least two support nodes are moved toward and away from the center axis; and at least three worksurface sectors, each worksurface sector having an upper worksurface, opposite ends and radially spaced inner and outer edges, the inner edges defining a center opening there between, wherein the opposite ends of each sector are moveably supported by adjacent pairs of the support nodes, and wherein each support node moveably supports adjacent ends of a pair of worksurface sectors, wherein the adjacent ends of each pair of worksurface sectors are movable toward and away from each other as the at least three support nodes are repositioned between the contracted and expanded configurations, and wherein a size of the center opening is changeable as the worksurface sectors are moved toward and away from each other.

2. The reconfigurable conference table of claim 1 further comprising an actuator coupled to at least one of the support nodes, wherein the actuator is moveable between at least first and second positions, wherein the at least two of the support nodes are moveable toward and away from the center axis as the actuator is moved between the first and second positions.

3. The reconfigurable conference table of claim 2 wherein the actuator comprises a linear actuator.

4. The reconfigurable conference table of claim 2 wherein the actuator is anchored to a floor supporting the at least one support node.

5. The reconfigurable conference table of claim 1 wherein the at least three support nodes are moveable toward and away from the center axis.

6. The reconfigurable conference table of claim 1 wherein each of the at least three support nodes comprises first and second tracks extending laterally outwardly from each support node, and wherein both ends of each worksurface sector comprise a guide disposed along a bottom of the worksurface sector, wherein the guides are engaged with one of the first or second tracks.

7. The reconfigurable conference table of claim 1 wherein each support node comprises a shroud overlying and covering the adjacent ends of each pair of worksurface sectors.

8. The reconfigurable conference table of claim 1 wherein each support node comprises a first monitor positioned above the upper worksurfaces of the worksurface sectors and facing one of the worksurface sectors disposed across the center opening from the support node.

9. The reconfigurable conference table of claim 8 wherein each support node further comprises a second monitor positioned below the upper support surfaces of the worksurface sectors and facing one of the worksurface sectors disposed across the center opening from the support node.

10. The reconfigurable conference table of claim 1 further comprising a drive mechanism coupled between at least one of the support nodes and at least one of the worksurface sectors, the drive mechanism operable between at least first and second modes, wherein the at least two support nodes are moveable toward and away from the center axis as the drive mechanism is operable between the first and second modes.

11. The reconfigurable conference table of claim 1 wherein the at least two support nodes each comprise a floor translation interface.

12. A reconfigurable conference table comprising:

an annulus shaped worksurface having a continuous, unbroken upper surface and radially spaced inner and outer peripheral edges, the inner peripheral edge defining a center opening, wherein the worksurface is moveable between a contracted configuration and an expanded configuration, wherein the outer peripheral edge has a first length in the contracted configuration and a second length in the expanded configuration, wherein the second length is greater than the first length, and wherein the upper surface is maintained continuous and unbroken as the worksurface is moved between the contracted and expanded configurations.

13. The reconfigurable conference table of claim 12 wherein the continuous, unbroken upper surface is defined by three sectors having opposite ends and three shrouds, wherein the sectors are arranged in an end-to-end configuration and the three shrouds overlie and cover the ends of adjacent pairs of sectors.

14. The reconfigurable conference table of claim 13 further comprising three support nodes supporting the ends of the sectors, wherein the three shrouds are coupled to the three support nodes respectively.

15. The reconfigurable conference table of claim 14 wherein at least two of the support nodes are moveable toward and away from a center axis, and wherein the worksurface is moveable between the contracted and expanded configurations as the at least two support nodes are moved toward and away from the center axis.

16. The reconfigurable conference table of claim 15 further comprising an actuator coupled to at least one of the support nodes, wherein the actuator is moveable between at least first and second positions, wherein the at least two of the support nodes are moveable toward and away from the center axis as the actuator is moved between the first and second positions.

17. The reconfigurable conference table of claim 16 wherein the actuator comprises a linear actuator.

18. The reconfigurable conference table of claim 14 wherein the at least three support nodes are moveable toward and away from the center axis.

19. The reconfigurable conference table of claim 14 wherein each of the at least three support nodes comprises first and second tracks extending laterally outwardly from each support node, and wherein both ends of each sector comprise a guide disposed along a bottom of the sector, wherein the guides are engaged with one of the first or second tracks.

* * * * *